United States Patent [19]

Muto

[11] 3,980,080

[45] Sept. 14, 1976

[54] AIR FILTRATION GAS MASS

[76] Inventor: Rudolph Muto, 24 Williams St., Andover, Mass. 01810

[22] Filed: Dec. 23, 1974

[21] Appl. No.: 535,446

[52] U.S. Cl. ..... 128/146.6; 55/95; 55/223; 55/244; 55/355; 55/DIG. 35; 128/142.6; 128/146.5

[51] Int. Cl.[2] ..... A62B 7/10

[58] Field of Search ..... 128/140 R, 141, 142.4, 128/142.6, 145 A, 145 R, 146, 146.2, 146.3, 146.4, 146.5, 146.6, 146.7, 147, 185, 186, 187, 188, 191, 193, 194, 195, 203, 205, 206, 209, 210, 211, 212; 55/84, 95, 223, 244, 318, 355, 421, DIG. 18, DIG. 35

[56] References Cited

UNITED STATES PATENTS

| | | | |
|---|---|---|---|
| 300,246 | 6/1884 | Goldberg | 128/145 R |
| 1,196,539 | 8/1916 | Goldberg | 128/146.6 |
| 1,789,262 | 11/1931 | Monro et al. | 128/140 R |
| 2,088,720 | 8/1937 | Poliniak | 128/146.4 |
| 2,725,876 | 12/1955 | Maille | 128/145 A |
| 2,875,759 | 3/1959 | Gallgher, Jr. | 128/146 |
| 2,895,472 | 7/1959 | Matheson | 128/146.6 |

FOREIGN PATENTS OR APPLICATIONS

| | | | |
|---|---|---|---|
| 959,619 | 3/1957 | Germany | 128/146.6 |

*Primary Examiner*—William E. Kamm
*Attorney, Agent, or Firm*—John H. Pearson

[57] ABSTRACT

An air filtration unit of the type having a liquid filtration medium in a canister with air entering below the level of the liquid, bubbling up into an upper air chamber and thence conducted to a face mask, is simplified for use not only in sedentary occupations but so that it can be used by workmen in strenuous occupations requiring leaning over, lying down, etc. One way valves assure that only scrubbed air enters the face mask, the mask is peripherally sealed and float, or gravity, valves prevent leakage into the mask, or out of the canister, when the unit is in abnormal position. In non-portable form, air filtration masks, peripherally sealed on the wearer's face have a common air chamber with air drawn thereinto from outside the pollution environment.

3 Claims, 8 Drawing Figures

AIR FILTRATION GAS MASS

BACKGROUND OF THE INVENTION

In many industries, workers are required to perform various functions where the ambient air contains toxic or irritating vapors or particles. In such a situation, the workers need personal air filtration devices, popularly called "gas masks", for removing harmful substances from their breathing air. Various solid chemical filtration media are known in the art for use with gas masks. Activated charcoal and silica gel are among those substances frequently used for this purpose. However, solid filtration media present a problem to the user. Specifically, the filtration medium used in a gas mask eventually becomes saturated with contaminants from the filtered air and, therefore, the medium must be removed and replaced. The required periodic removal and replacement of a solid filtration medium is expensive and can be difficult to accomplish. The use of a liquid filter media or more specifically, a water filter medium, largely eliminates the problems discussed above associated with solid air filters for gas masks because, in most cases, water is readily available and can be easily and inexpensively obtained for replacement purposes.

The use of a liquid as a filtration medium for impurities in gases is well known in the prior art. More specifically, it is also known to use water to filter impurities from air to be inhaled. For example, U.S. Pat. No. 3,703,179 shows a smoke filtering device including a mouthpiece connected to a canister partially filled with water. A cigarette is inserted in an inlet to the cannister so that inhalation at the mouthpiece causes smoke to flow into the canister, through the filtering water and out through the mouthpiece. Similar devices are shown in U.S. Pat. Nos. 183,626, 1,826,331, and 3,209,765. Each of these devices is portable and operates properly when carried about with the user provided that the device is continuously oriented in approximately an upright position. It should be noted that if the orientation of any of these devices significantly deviates from the upright position, water flows out through the mouthpiece and/or out through the inlet port thereby gagging the user or extinguishing the tobacco. Thus the user could not bend head down over a work bench or lie on his side in a mine tunnel without spillage.

In U.S. Pat. No. 2,088,720 to Poliniak of Aug. 3, 1937 and German Pat. 959619 to Drager of Mar. 7, 1957, liquid filter gas masks are disclosed but with no means for preventing liquid from leaking into the face mask when inverted. In U.S. Pat. No. 1,196,539 to Goldberg of Aug. 29, 1916 a liquid filter gas mask is disclosed in which an immovable tapered guard, with a restricted opening is stated to prevent splash but no valve means is provided to permit simple construction with unrestricted openings capable of positive closing to prevent leakage.

Additionally, complex gas filtration devices having a liquid filter medium are used in many industrial chemical processes. One such apparatus is disclosed in U.S. Pat. No. 3,733,782. Such devices however, are stationary and intended for use only in one orientation.

It is therefore desirable to provide a portable air filtration unit which is secured to the user and easily carried about by him and which continues to function properly over a wide range of orientations since the user is likely to assume a variety of different positions while still needing to breathe filtered air. In addition, the device should provide filtered air to the nose and mouth of the user so that his breathing remains unencumbered and natural.

SUMMARY OF THE INVENTION

An object of this invention is to provide an effective, portable, personal air filtration unit having a liquid filter to remove harmful or irritating substances from inhaled air, and capable of being temporarily inverted without spillage.

Other objects of the invention will be obvious to those skilled in the art on their reading this application.

In accordance with the objects of this invention there is provided a portable unit for filtering particles of liquid soluble gases and vapors from inhaled air, the unit having a sealed canister partially filled with a liquid filtration medium, the canister having an inlet check valve and a float actuated exhaust valve. The inlet valve admits ambient air into the canister and prevents either air or liquid from flowing out of the canister. The inlet valve releases incoming air beneath the liquid's surface in the canister. When the canister is in the upright position, the exhaust valve is located above the surface of the liquid in the canister and permits air to flow out of the canister. However, the exhaust valve closes if the liquid rises to the level of the exhaust valve. In this case, the liquid engages a buoyant spherical float member of the valve which closes the exhaust valve and prevents liquid from spilling out of the container.

A conduit provides an essentially airtight passageway from the canister exhaust valve to a face mask worn over the nose and mouth of a user of the air filtration unit. The face mask includes an inlet valve which receives air from the conduit and exhaust valves which discharge exhaled air directly into the ambient air.

Inhalation by the user draws ambient air in through the canister inlet valve, through the liquid filtration medium where impurities in the air are absorbed by the water, out through the exhaust valve and into the conduit leading to the face mask. The inlet and exhaust valves in the canister are positioned so that the user can assume a variety of positions without impairing the filtering capability of the filter unit. A perforated plate at the bottom of the inlet conduit, at a predetermined distance below liquid level, breaks up any large bubbles into small bubbles.

In another embodiment of the invention, the canister is divided into several chambers to improve the range of positions over which the filter is operational. In this embodiment, inlet and exhaust valves again prevent the liquid filtration medium from spilling out of the canister. In each embodiment, a secondary air filter provides a flow of filtered air to the user when the exhaust valve closes.

DESCRIPTION OF THE PREFERRED EMBODIMENT

In this application and accompanying drawings, there is shown and described a preferred embodiment of the invention and suggested various alternatives and modifications thereof, but it is to be understood that these are not intended to be exhaustive and that other changes and modifications can be made within the scope of the invention. These suggestions are selected and included for purposes of illustration in order that others skilled in the art will more fully understand the invention and the principles thereof and will be best suited in the condition of a particular case.

Figure 1:
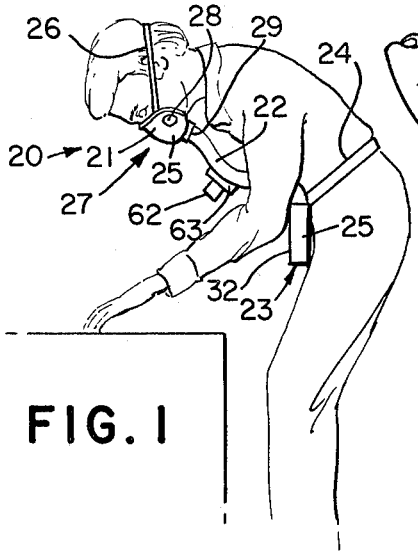
FIG. 1 shows one embodiment of the portable air filtration system of the invention secured to a user.

As shown in FIG. 1, a portable, air filter 20 of the invention includes a face mask 21, conduit 22 and canister 23, the canister being supported by a suitable strap, or belt 24.

The face mask 21 is formed of relatively low cost material such as plastic 25 and is held in place covering the mouth and nose of the user by a stretchable strap 26, which extends around the back of the head. Mask 21 includes valve means 27 in the form of at least one, one-way air exhaust, valve 28, which prevents admission of ambient air but permits discharge of used air after breathing. Mask 21 also includes as part of valve means 27, at least one, one-way inlet valve 29 which permits air to be received into the mask from conduit 22 but does not permit used air to enter the conduit 22 or canister 23. Canister 23 is also formed of low cost sheet material such as plastic 25 and is preferably, relatively thin and flat with front wall 32, rear wall 33, side walls 34 and 35, bottom wall 36 and top wall 37. The walls of the canister are semi-rigid self-supporting and sufficiently thick to resist collapse under the slight vacuums exerted within the lower liquid chamber 38 and the upper air chamber 39.

Figure 2:
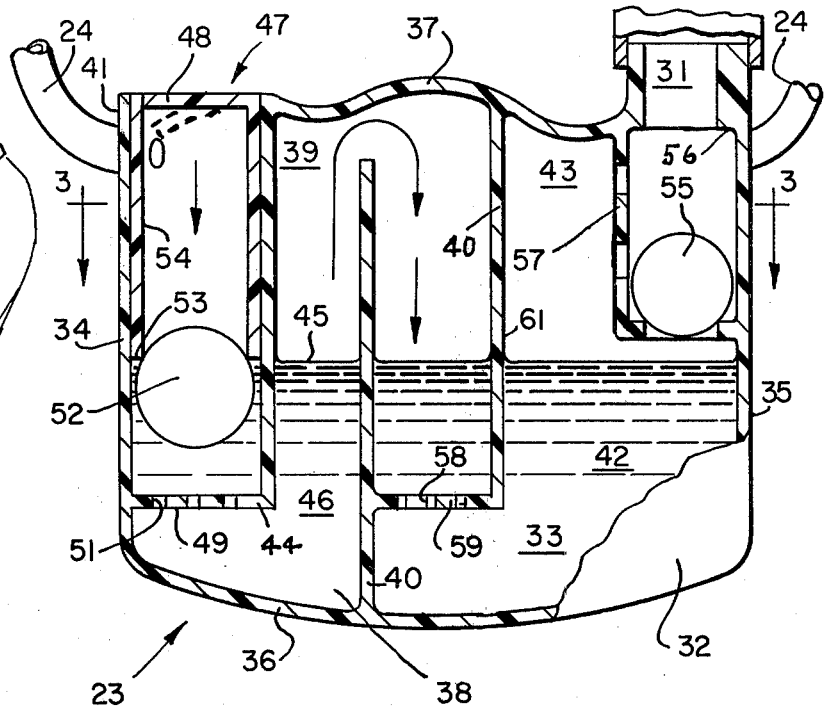
FIG. 2 is an enlarged front elevational view, in half section of a double chambered canister.
Figure 3:
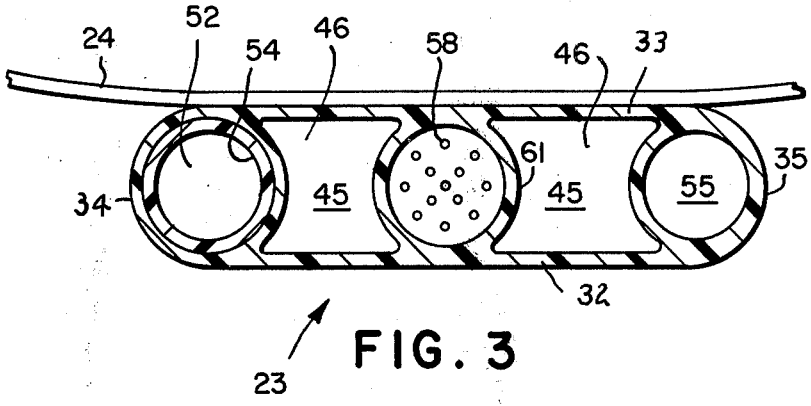
FIG. 3 is a plan view in section on line 3—3 of FIG. 2.

Canister 23 includes the inlet port 41, as well as the outlet, or exhaust, port 31 and while there may be only one liquid chamber 38, in FIGS. 2 and 3 a pair of successive liquid chambers 38 and 42 and a pair of air chambers 39 and 43, formed by partition 40, are shown. Inlet port 41 is a conduit leading from the ambient atmosphere to a terminal tip 44 which is at a predetermined distance below the level of the surface 45 of the liquid filtration medium 46. Medium 46 is preferably water although it could be any desired liquid for a particular filtering object. Preferably, for use in a face mask such as shown, a tip about one inch below the surface of the water 46 has been found to give the best results, and to scrub the incoming air without delaying, or barring its passage unduly. The canister 23 may be an elongated sausage like casing extending entirely around the waist of the wearer, to provide additional volume of liquid filtering medium, if desired.

Valve means 47 in canister 23 includes a one way inlet valve 48 in inlet port 41, for admitting air from the ambient atmosphere, the air being contaminated or polluted with pollen, fiberglass, fibers, asbestos or the like. The flap of valve 48 is normally mechanically biased to closed position but is free to open to admit air into the canister.

A perforated plate, or screen, 49, having perforations 51 of predetermined area, or mesh, is mounted across the tip 44 of inlet port 41 in order to prevent passage, or formation of, large bubbles and to insure that a multiplicity of small bubbles are formed for better scrubbing of the foreign particles out of the air. The surface area between the air and the liquid 46 is thus greatly increased to increase the absorption of impurities by liquid 46.

A similar plate 58 is provided at the tip 59 of second inlet port 61 of the second liquid chamber 42.

Valve means 47 also includes a float valve 52, captive in the inlet port 41 and having a seat 53 formed by a concentric tube 54 and a float valve 55 captive in the exhaust port 31, and having a similar seat 56 formed by a concentric, cage-like tube 57.

In operation, inhalation by the wearer of sealed face mask 21 creates a partial vacuum in canister 23 which draws air through the intake port 41 and inlet valve 48. The air stream through inlet port 41 and through apertures 51 of plate 49 is released under liquid 46 as a plurality of streams of small bubbles. The contaminants are thereby wetted and absorbed by liquid 46 and the purified, washed or scrubbed air collects in upper chamber 39. In the double chambered type of FIG. 2, the air in chamber 39 is again released from the tip 59 of port 61 to again be washed free of impurities and collect in upper chamber 43. The air released into chamber 43 passes out through exhaust port 31 into conduit 22, thence through mask inlet valve 29, for breathing and discharge through valve 28.

The portability of the device permits the user to travel about at will and if his work requires leaning over head down, crawling under a machine or other unusual positions of work the float valves will close to prevent leakage of liquid. Sufficient cleaned air remains in the conduit to permit shut off from the canister for short periods. A supplementary, or secondary, filter 62 provides an emergency flow of filtered air to the mask wearer if the disorientation is prolonged and until he can become reoriented. This may be a felt filter placed in operation by merely flipping open a closure 63.

Figure 5:
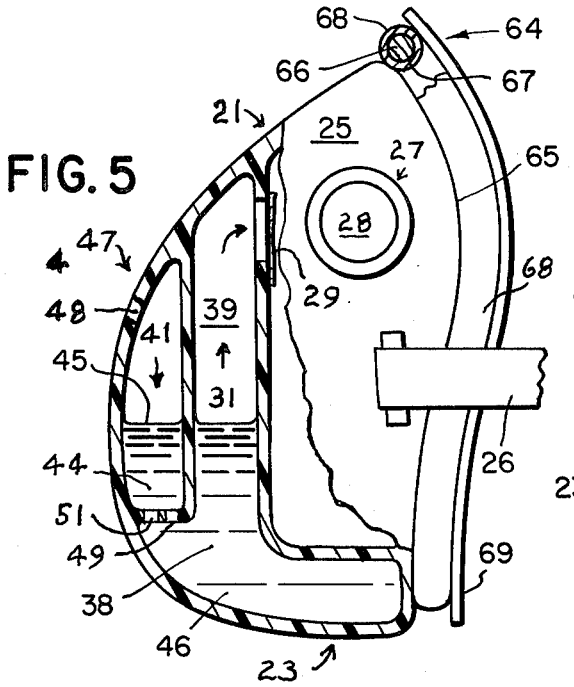
FIG. 5 is a side elevational view of a face mask having a built-in liquid canister.

As shown in FIG. 5, the canister 23 may be built into the face mask 21, there being a relatively small volume liquid chamber 38 and air chamber 39 and the valve means 27 as described above.

In FIG. 5 is shown a preferred form of seal 64, extending around the periphery 65 of the mask and including an endless band 66 of a putty-like, soft deformable substance 67 encased in a plastic casing 68, somewhat like an endless sausage. Attached to the casing 68 is a ribbon, or tape, of thin sheet plastic 69, such as "Saran Wrap," (a plastic film of the Dow Chemical Company, Midland, Michigan) or the like, so that the deformable casing may conform with the contours of the face and the plastic ribbon adhere by static electricity to firmly seal the mask.

Figure 6:
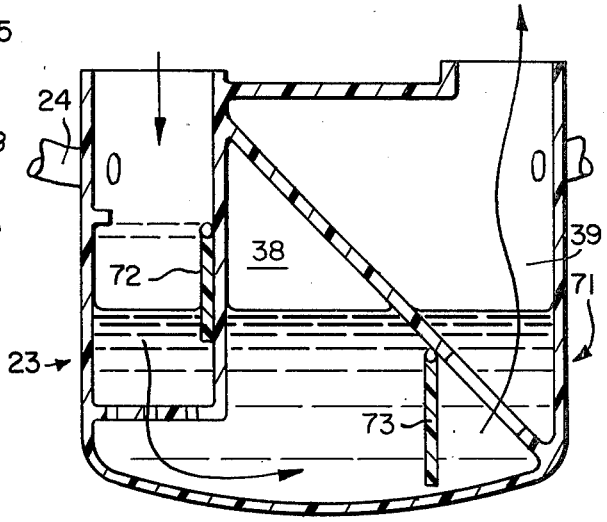
FIG. 6 is a front elevational view of a single chambered canister having gravity activated valves to prevent leakage.

In FIG. 6 a canister 71 similar to canister 23 is shown but having a pair of gravity actuated valves 72 and 73 for preventing leakage when the user is engaged in strenuous activity.

Figure 4:
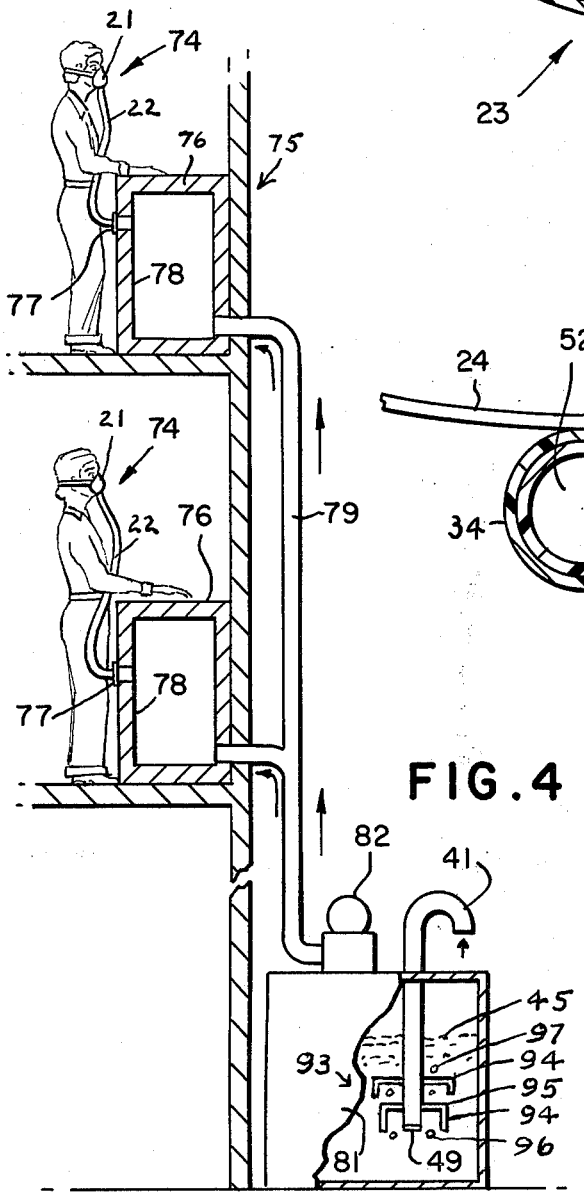
FIG. 4 is a diagrammatic side elevation on a reduced scale showing a central canister feeding fresh air to a plurality of workers.

In FIG. 4 a plurality of workers 74 are shown in a factory 75, each working at a bench, such as 76 and each wearing a mask 21 with a conduit 22. Instead of a portable canister, however, the conduits 22 are attachable by a sliding fit on a port 77 of plenums 78 which are connected by conduits 79 to a fixed large canister 81, corresponding to canister 23. A vacuum pump 82 pulls air into the canister 81 to bubble up under water and forces the scrubbed air up into the system to supply the masks.

Figure 7:
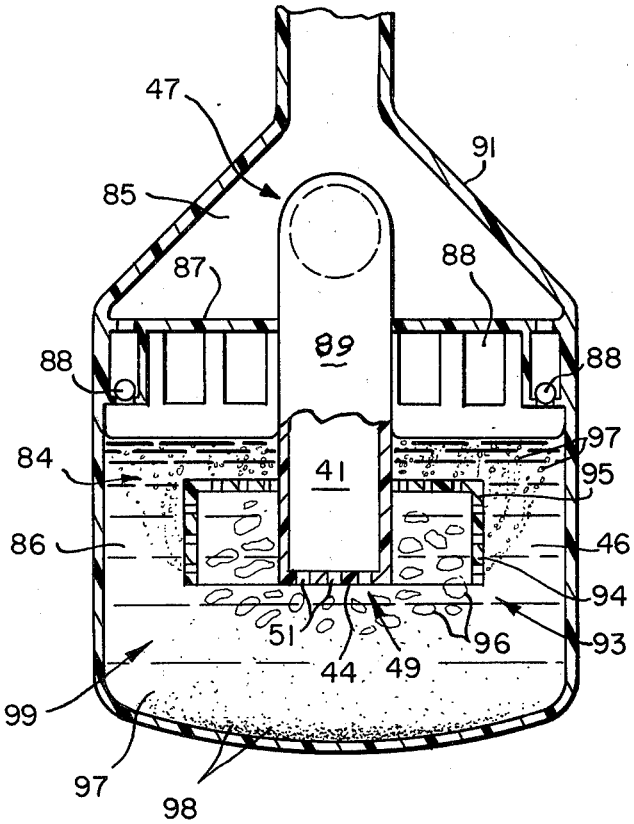
FIG. 7 is a front elevational view, in half section, of another embodiment of the invention.

As shown in FIG. 7, the canister 84 has an upper air chamber 85 separated from the lower liquid chamber 86 by the partition 87, the partition 87 having a plurality of one way float valves such as 88 spaced around the periphery thereof. The inlet port 89 is in the truncated conical side wall 91 and includes the valve means 47 and perforated plate means 49 of the other embodiments. Thus, regardless of how the canister is tilted, the float valves at the bottom close to block leakage while the valves at the top remain open to continue to pass air up into the face mask.

It should be noted that the portable canisters of the invention, such as 23, are so supported on the wearer, that they hang downwardly when the wearer leans over, or rolls over on his back as well as when the wearer is upright. Thus the valves for preventing leakage, and normally depending position of the canister, cooperate in permitting strenuous occupational use of the mask and canister.

Preferably as shown in FIGS. 4 and 7, the perforated plate 49 is provided with apertures 51 of predetermined mesh size and is supplemented by at least one additional perforated plate means 93, formed by a plate 94 of inverted cup shape, concentric with the inlet tube 41, and having apertures 95 of progressively less diameter, in each successive plate 94 so that larger bubbles 96, emitted from apertures 51, are converted to smaller bubbles 97 as they rise to the surface, for better scrubbing. The foreign particles 98 fall to the sump 97, in the area 99 which is free of the turbulence caused by the bubbles.

Figure 8:
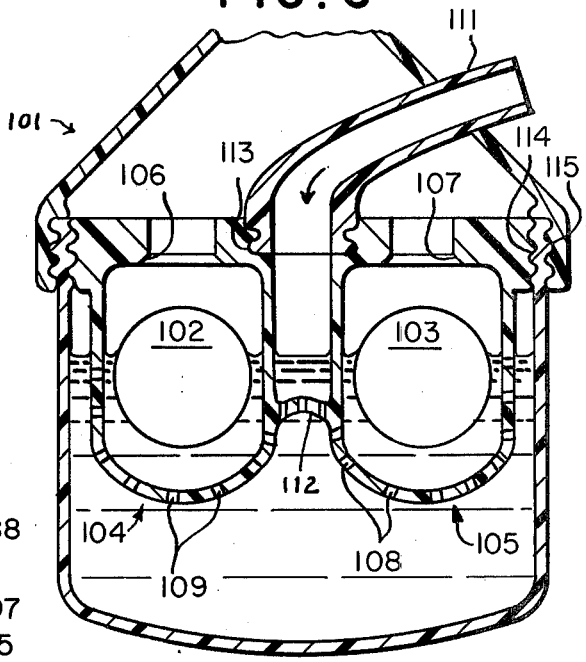
FIG. 8 is a view similar to FIG. 7 of another embodiment of the invention.

As shown in FIG. 8, a portable canister 101 may be wide and narrow, to be carried on a belt near the hip, there being a pair of oppositely disposed ball floats 102 and 103 captive in cages 104 and 105 and having valve seats 106 and 107. Cages 104 and 105 may be of plastic and have perforations 108 and 109 about ⅛ inch in diameter. The inlet tube 111 has a concave-convex port 112 and the ports are readily removably by threads such as 113, 114 and 115, or the equivalent.

I claim:

1. In a gas mask of the type having a face mask, a canister and a conduit connecting the same, the improvement comprising:

a canister of relatively stiff, semi-rigid self-supporting sheet material, resistant to collapse under slight vacuum, said canister having a lower chamber, an upper chamber, and a liquid filtration medium in the lower chamber, an air inlet conduit, leading from the atmosphere into said canister and terminating in a tip at a predetermined distance below the level of the liquid in said lower chamber;

a plate, or screen, across said tip having apertures of predetermined area for breaking up large bubbles;

valve means in said canister for admitting air but automatically preventing liquid leakage therefrom, a face mask, covering the mouth and nose of a user said mask being connected to the upper chamber of said canister for receiving air therefrom, ball float valve means in the upper chamber of said canister normally permitting passage of air into said face mask but closing to bar passage of liquid thereinto when said mask is unduly tilted or inverted;

valve means in said face mask for admitting fresh air from said canister, preventing discharge of air into said canister and permitting discharge of air into the atmosphere and a seal extending around the periphery of said mask, said seal comprising a putty-like, soft deformable substance encased in a plastic casing and having a narrow band of thin plastic sheeting attached thereto;

whereby said encased deformable substance conforms to the contours of the face of the user and said plastic band adheres to the skin by static electricity to effectively form a seal.

2. An air filtration unit of the type having at least one face mask connected to a canister having an upper air chamber, a lower liquid chamber and an ambient air inlet located below the level of the liquid in said lower chamber, said unit characterized by:

canister inlet, one-way, valve means for admitting ambient air into said lower liquid chamber but preventing out flow of air, and liquid, from said canister;

face mask inlet, one-way, valve means for admitting scrubbed air from the upper chamber of said canister into said mask but preventing return of air from said face mask into said canister;

face mask exhaust, one-way, valve means for permitting discharge of air from said face mask but preventing ambient air from entering said mask and leakage prevention, one-way, valve means located between the upper chamber of said canister and said face mask inlet valve mean, actuated by an abnormal position of said unit, to close and prevent canister liquid from entering said face mask during strenuous movement of the wearer said leakage prevention valve means comprising a pair of one-way, ball float valves, within said canister, one operable in the ambient air inlet to close when said unit is unduly tilted in the direction of said inlet and the other operable in advance of the scrubbed air inlet of said face mask to close when said unit is unduly tilted in the direction of said face mask inlet.

3. An air filtration unit of the type having at least one face mask connected to a canister having an upper air chamber, a lower liquid chamber and an ambient air inlet located below the level of the liquid in said lower chamber, said unit characterized by:

canister inlet, one-way, valve means for admitting ambient air into said lower liquid chamber but preventing out flow of air, and liquid, from said canister;

face mask inlet, one-way, valve means for admitting scrubbed air from the upper chamber of said canister into said mask but preventing return of air from said face mask into said canister;

face mask exhaust, one-way, valve means for permitting discharge of air from said face mask but preventing ambient air from entering said mask and leakage prevention, one-way, valve means located between the upper chamber of said canister and said face mask inlet valve means, actuated by an abnormal position of said unit, to close and prevent canister liquid from entering said face mask during strenuous movement of the wearer, an endless band of soft deformable substance encased in a plastic casing, extending around the periphery of said mask, and an endless tape of thin, sheet plastic, attached to said band and extending around the periphery of said mask said tape adhering said band to the face of the wearer by static electricity.

* * * * *

UNITED STATES PATENT OFFICE

CERTIFICATE OF CORRECTION

Patent No. 3980080 Dated September 14, 1976

Inventor(s) Rudolph Muto

It is certified that error appears in the above-identified patent and that said Letters Patent are hereby corrected as shown below:

The corrected title is:

AIR FILTRATION GAS MASK

Signed and Sealed this

Sixteenth Day of November 1976

[SEAL]

*Attest:*

RUTH C. MASON
*Attesting Officer*

C. MARSHALL DANN
*Commissioner of Patents and Trademarks*